US008988322B2

(12) United States Patent
Sugimoto

(10) Patent No.: US 8,988,322 B2
(45) Date of Patent: Mar. 24, 2015

(54) DISPLAY UNIT WITH GRADATION CONTROL, METHOD OF DRIVING THE SAME, AND ELECTRONICS DEVICE

(75) Inventor: Hideki Sugimoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 357 days.

(21) Appl. No.: 12/831,677

(22) Filed: Jul. 7, 2010

(65) Prior Publication Data

US 2011/0013100 A1 Jan. 20, 2011

(30) Foreign Application Priority Data

Jul. 14, 2009 (JP) ..... 2009-165378

(51) Int. Cl.
*G09G 3/30* (2006.01)
*G09G 3/20* (2006.01)
*G09G 3/32* (2006.01)

(52) U.S. Cl.
CPC ..... *G09G 3/2014* (2013.01); *G09G 3/3233* (2013.01); *G09G 2320/043* (2013.01); *G09G 2300/0819* (2013.01); *G09G 2300/0842* (2013.01); *G09G 2300/0866* (2013.01)
USPC ..... 345/76; 345/82

(58) Field of Classification Search
CPC G09G 3/10; G09G 3/12; G09G 3/32–3/3291; G09G 2300/026–2300/029; G09G 2310/02–2310/0297; G09G 2310/061–2310/063
USPC ..... 345/36, 45, 76–81; 315/169.3
See application file for complete search history.

(56) References Cited

U.S. PATENT DOCUMENTS

| | | | | |
|---|---|---|---|---|
| 4,975,691 | A * | 12/1990 | Lee | 345/79 |
| 5,095,377 | A * | 3/1992 | Kobayashi et al. | 345/97 |
| 5,436,742 | A * | 7/1995 | Tanaka et al. | 349/25 |
| 5,796,381 | A * | 8/1998 | Iwasaki et al. | 345/101 |
| 6,417,828 | B1 * | 7/2002 | Sato et al. | 345/89 |
| 8,325,109 | B2 * | 12/2012 | Yamashita et al. | 345/55 |
| 2001/0045933 | A1 * | 11/2001 | Sakaigawa et al. | 345/98 |
| 2002/0196210 | A1 * | 12/2002 | Moon | 345/75.2 |
| 2004/0119678 | A1 * | 6/2004 | Izumi | 345/94 |
| 2004/0263440 | A1 * | 12/2004 | Kimura et al. | 345/76 |
| 2005/0280613 | A1 * | 12/2005 | Takei et al. | 345/76 |
| 2007/0080906 | A1 * | 4/2007 | Tanabe | 345/76 |
| 2008/0007547 | A1 * | 1/2008 | Hasumi et al. | 345/211 |
| 2008/0136750 | A1 * | 6/2008 | Benzarti | 345/76 |
| 2008/0272989 | A1 * | 11/2008 | Takahashi et al. | 345/76 |
| 2009/0046043 | A1 * | 2/2009 | Ono et al. | 345/79 |
| 2010/0013746 | A1 * | 1/2010 | Seto | 345/76 |
| 2011/0205217 | A1 * | 8/2011 | Park et al. | 345/212 |

FOREIGN PATENT DOCUMENTS

JP 2008-009391 1/2008

* cited by examiner

*Primary Examiner* — Sanghyuk Park
(74) *Attorney, Agent, or Firm* — Dentons US LLP

(57) ABSTRACT

A display unit with which gradation control is facilitated, a method of driving the same, and an electronics device are provided. The display unit includes: a pixel circuit array section including a plurality of scanning lines arranged in rows, a plurality of signal lines arranged in columns, and a plurality of light emitting devices and a plurality of pixel circuits arranged in a matrix state correspondingly to an intersection of each scanning line and each signal line; a signal line drive circuit sequentially applying a signal voltage corresponding to a video signal to each signal line, and applying an erasing pulse to a specific signal line at given timing so that a duty ratio determined based on the video signal is obtained; and a scanning line drive circuit applying a given selection pulse to the scanning line while the erasing pulse is applied to the specific signal line.

7 Claims, 9 Drawing Sheets

| | $T_{on1}$ | $T_{on2}$ | $T_{on3}$ | $T_{on4}$ | DUTY RATIO |
|---|---|---|---|---|---|
| MODE 1 | LIGHT EMISSION | NON LIGHT EMISSION | NON LIGHT EMISSION | NON LIGHT EMISSION | $T_{on1}/T_F$ |
| MODE 2 | LIGHT EMISSION | LIGHT EMISSION | NON LIGHT EMISSION | NON LIGHT EMISSION | $(T_{on1}+T_{on2})/T_F$ |
| MODE 3 | LIGHT EMISSION | LIGHT EMISSION | LIGHT EMISSION | NON LIGHT EMISSION | $(T_{on1}+T_{on2}+T_{on3})/T_F$ |
| MODE 4 | LIGHT EMISSION | LIGHT EMISSION | LIGHT EMISSION | LIGHT EMISSION | $(T_{on1}+T_{on2}+T_{on3}+T_{on4})/T_F$ |

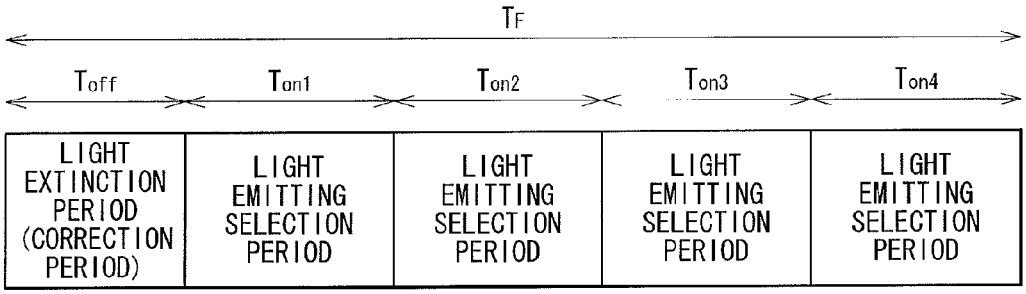

FIG. 3

| | $T_{on1}$ | $T_{on2}$ | $T_{on3}$ | $T_{on4}$ | DUTY RATIO |
|---|---|---|---|---|---|
| MODE 1 | LIGHT EMISSION | NON LIGHT EMISSION | NON LIGHT EMISSION | NON LIGHT EMISSION | $T_{on1}/T_F$ |
| MODE 2 | LIGHT EMISSION | LIGHT EMISSION | NON LIGHT EMISSION | NON LIGHT EMISSION | $(T_{on1}+T_{on2})/T_F$ |
| MODE 3 | LIGHT EMISSION | LIGHT EMISSION | LIGHT EMISSION | NON LIGHT EMISSION | $(T_{on1}+T_{on2}+T_{on3})/T_F$ |
| MODE 4 | LIGHT EMISSION | LIGHT EMISSION | LIGHT EMISSION | LIGHT EMISSION | $(T_{on1}+T_{on2}+T_{on3}+T_{on4})/T_F$ |

FIG. 4

DISPLAY UNIT WITH GRADATION CONTROL, METHOD OF DRIVING THE SAME, AND ELECTRONICS DEVICE

BACKGROUND OF THE INVENTION

1. Field of the Invention

The present invention relates to a display unit that displays an image with the use of a light emitting device arranged for every pixel and a method of driving the same. The present invention further relates to an electronics device including the foregoing display unit.

2. Description of the Related Art

In recent years, in the field of display units for displaying images, display units including a current drive type optical device with the light emitting luminance changeable according to the flowing current value such as an organic EL (electro luminescence) device as a light emitting device of a pixel have been developed, and such display units are facilitated to be commercialized.

The organic EL device is a self-light emitting device differently from a liquid crystal device or the like. Thus, a display unit (organic EL display unit) including the organic EL device does not need a light source (backlight). Accordingly, in the organic EL display unit, compared to a liquid crystal display unit necessary for a light source, the image visibility is high, the electric power consumption is low, and the device response rate is high.

Drive systems in the organic EL display unit include simple (passive) matrix system and active matrix system as the drive system thereof as in the liquid crystal display unit. The former system has a disadvantage that it is difficult to realize a large and high definition display unit, though its structure is simple. Thus, currently, the active matrix system has been actively developed. In such a system, a current flowing through a light emitting device arranged for every pixel is controlled by an active deice provided in a drive circuit provided for every light emitting device (in general, TFT (Thin Film Transistor)).

SUMMARY OF THE INVENTION

In general, in the organic EL display unit, in executing light emission and light extinction of the organic EL device during one frame period, a duty ratio as a ratio of light emitting period during one field period (light emitting period/1 field period*100) is constant for all pixels. Thus, in the case where the number of gradations is increased, the voltage value capable of being applied to a signal line is increased. However, in this case, the voltage value difference between each gradation becomes small, and gradation control becomes difficult.

In view of the foregoing disadvantage, in the invention, it is desirable to provide a display unit with which gradation control is facilitated, a method of driving the same, and an electronics device.

According to an embodiment of the invention, there is provided a display unit including a pixel circuit array section that includes a plurality of scanning lines arranged in rows, a plurality of signal lines arranged in columns, and a plurality of light emitting devices and a plurality of pixel circuits arranged in a matrix state correspondingly to an intersection of each scanning line and each signal line. The display unit further includes a signal line drive circuit and a scanning line drive circuit. The signal line drive circuit sequentially applies a signal voltage corresponding to a video signal to each signal line, and applies an erasing pulse to a specific signal line at given timing so that a duty ratio determined based on the video signal is obtained. The scanning line drive circuit applies a given selection pulse to the scanning line while the erasing pulse is applied to the specific signal line.

According to an embodiment of the invention, there is provided an electronics device including the foregoing display unit.

According to an embodiment of the invention, there is provided a method of driving a display unit including the following three steps:

A. a step of preparing a display unit including the following structure,

B. a step of sequentially applying a signal voltage corresponding to a video signal to each signal line, and applying an erasing pulse to a specific signal line at given timing so that a duty ratio determined based on the video signal is obtained; and C. a step of applying a given selection pulse to a scanning line while the erasing pulse is applied to the specific signal line.

The display unit for which the foregoing method of driving the same is used includes a pixel circuit array section and a drive circuit that drives the pixel circuit array section. The pixel circuit array section includes a plurality of scanning lines arranged in rows, a plurality of signal lines arranged in columns, and a plurality of light emitting devices and a plurality of pixel circuits arranged in a matrix state correspondingly to an intersection of each scanning line and each signal line.

In the display unit, the method of driving the same, and the electronics device of the embodiments of the invention, the signal voltage corresponding to the video signal is sequentially applied to each signal line, and the erasing pulse is applied to the specific signal line at given timing so that the duty ratio determined based on the video signal is obtained. Further, the given selection pulse is applied to the scanning line while the erasing pulse is applied to the specific signal line. Thereby, not only that a height value of the signal voltage is able to be set for every pixel, but also the duty ratio is able to be set for every pixel.

According to the display unit, the method of driving the same, and the electronics device of the embodiments of the invention, not only that the height value of the signal voltage is able to be set for every pixel, but also the duty ratio is able to be set for every pixel. Thereby, gradation control is able to be facilitated.

Other and further objects, features and advantages of the invention will appear more fully from the following description.

BRIEF DESCRIPTION OF THE DRAWINGS

FIG. 3 is a diagram conceptually illustrating a state that one field is divided into five periods.

FIG. 4 is a relation diagram between duty ratios and modes.

DETAILED DESCRIPTION OF THE PREFERRED EMBODIMENT

Figure 1:
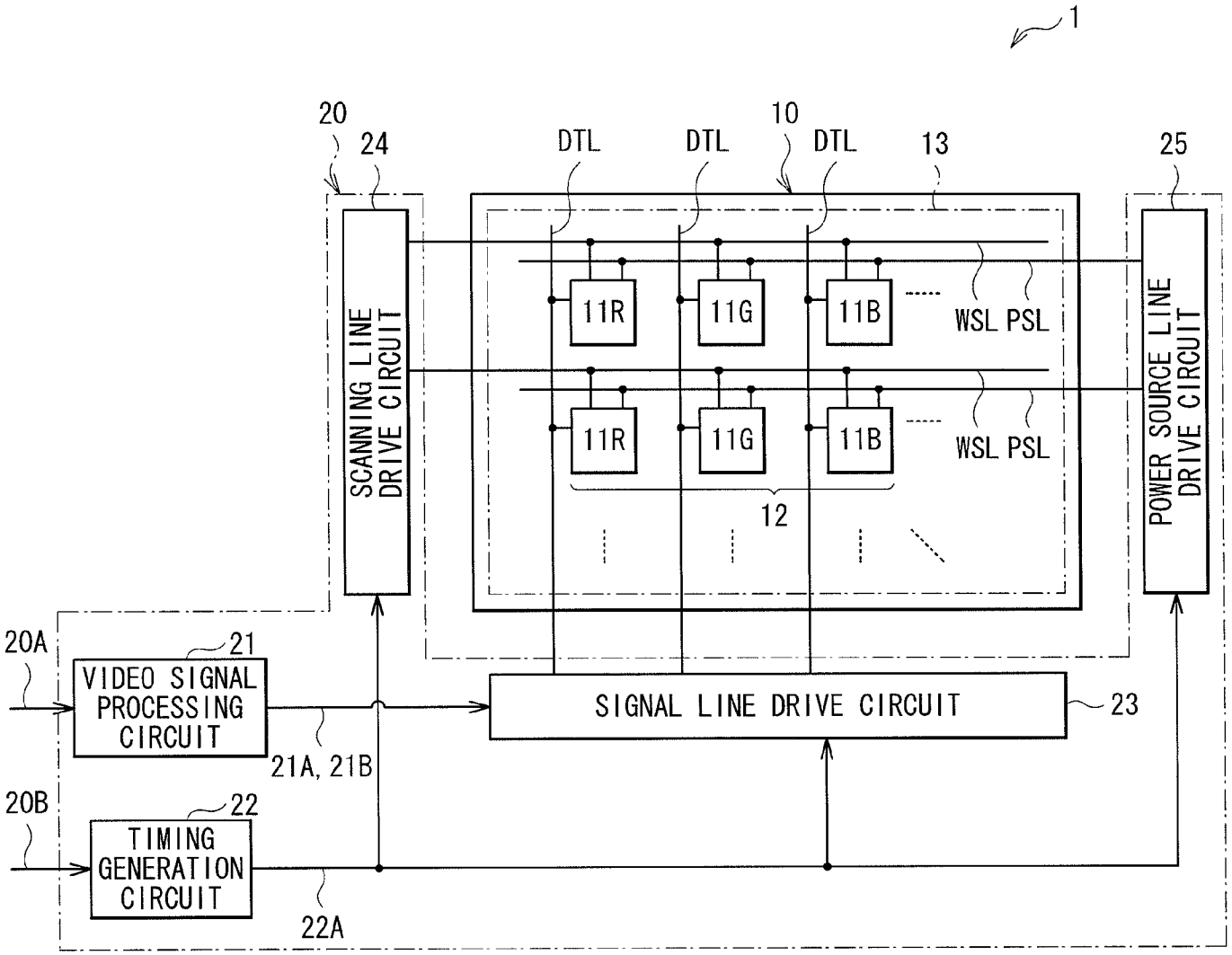
FIG. 1 is a structural view illustrating an example of a display unit according to an embodiment of the invention.

An embodiment of the invention will be hereinafter described in detail with reference to the drawings. The description will be given in the following order:

1. Embodiment
1.1 Schematic structure of display unit
1.2 Operation of video signal processing circuit
1.3. Operation of display unit
1.4. Action and effect
2. Module and application examples 1. Embodiment 1.1 Schematic Structure of Display Unit FIG. 1 illustrates a schematic structure of a display unit 1 according to an embodiment of the invention. The display unit 1 includes a display panel 10 and a drive circuit 20. The display panel 10 has a pixel circuit array section 13 in which, for example, a plurality of organic EL devices 11R, 11G, and 11B (light emitting device) are arranged in a matrix state. In this embodiment, for example, a combination of three organic EL devices 11R, 11G, and 11B adjacent to each other composes one pixel 12. In the following description, as a generic term of the organic EL devices 11R, 11G, and 11B, an organic EL device 11 is used as appropriate. The drive circuit 20 drives the pixel circuit array section 13, and, for example, has a video signal processing circuit 21, a timing generation circuit 22, a signal line drive circuit 23, a scanning line drive circuit 24, and a power source line drive circuit 25.

Pixel Circuit Array Section

Figure 2:
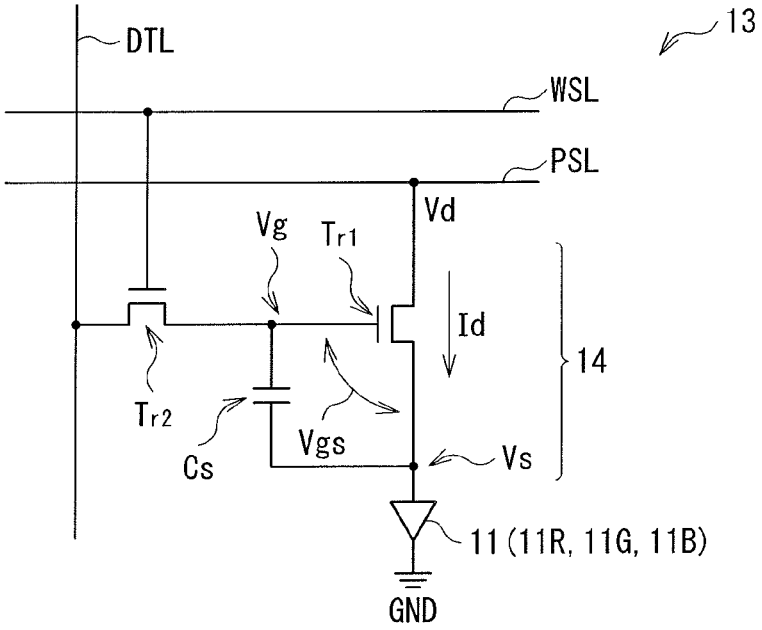
FIG. 2 is a structural view illustrating an example of an internal structure of the pixel circuit array section of FIG. 1.

FIG. 2 illustrates an example of a circuit structure of the pixel circuit array section 13. The pixel circuit array section 13 is formed in a display region of the display panel 10. For example, as illustrated in FIG. 1 and FIG. 2, the pixel circuit array section 13 has a plurality of scanning lines WSL arranged in rows, a plurality of signal lines DTL arranged in columns, and a plurality of power source lines PSL arranged in rows along the scanning lines WSL. The plurality of organic EL devices 11 and pixel circuits 14 are arranged in a matrix state (two dimensional arrangement) correspondingly to an intersection of each scanning line WSL and each signal line DTL. The pixel circuit 14 is composed of, for example, a drive transistor $T_{r1}$, a writing transistor $T_{r2}$, and a retentive capacity $C_s$, and has a circuit structure of 2Tr1C. The drive transistor $T_{r1}$ and the writing transistor $T_{r2}$ are formed from, for example, an n channel MOS type thin film transistor (TFT (Thin Film Transistor)). The TFT type is not particularly limited, and may be, for example, inversely staggered structure (so-called bottom gate type) or staggered structure (top gate type). Further, the drive transistor $T_{r1}$ or the writing transistor $T_{r2}$ may be a p channel MOS type TFT.

In the pixel circuit array section 13, each signal line DTL is connected to an output terminal (not illustrated) of the signal line drive circuit 23 and a drain electrode (not illustrated) of the writing transistor $T_{r2}$. Each scanning line WSL is connected to an output terminal (not illustrated) of the scanning line drive circuit 24 and a gate electrode (not illustrated) of the writing transistor $T_{r2}$. Each power source line PSL is connected to an output terminal (not illustrated) of the power source line drive circuit 25 and a drain electrode (not illustrated) of the drive transistor $T_{r1}$. A source electrode (not illustrated) of the writing transistor $T_{r2}$ is connected to a gate electrode (not illustrated) of the drive transistor $T_{r1}$ and one end of the retentive capacity $C_s$. A source electrode (not illustrated) of the drive transistor $T_{r1}$ and the other end of the retentive capacity $C_s$ are connected to an anode electrode (not illustrated) of the organic EL device 11. A cathode electrode (not illustrated) of the organic EL device 11 is connected to, for example, a ground line GND. The cathode electrode is used as a common electrode of each organic EL device 11, for example, is formed continuously over the entire display region of the display panel 10, and is in a state of a flat plate.

Drive Circuit

Next, a description will be given of each circuit in the drive circuit 20 provided around the pixel circuit array section 13 with reference to FIG. 1.

The video signal processing circuit 21 is intended to perform a specified correction of a digital video signal 20A inputted from outside, and output a corrected video signal 21A to the signal line drive circuit 23. Examples of the specified correction include gamma correction and overdrive correction. Further the video signal processing circuit 21 is intended to determine a duty ratio between light emitting period and light extinction period as a ratio of light emitting period during one field period (light emitting period/1 field period*100). Specifically, the video signal processing circuit 21 is intended to determine timing of outputting an erasing pulse (described later) determining the duty ratio and the signal line DTL to which the erasing pulse is outputted, for example, based on the video signal 20A or the video signal 21A. The video signal processing circuit 21 is, for example, intended to output an erasing control signal 21B indicating the determined timing and the determined signal line DTL to which the erasing pulse is outputted to the signal line drive circuit 23.

The timing generation circuit 22 is intended to execute control so that the signal line drive circuit 23, the scanning line drive circuit 24, and the power source line drive circuit 25 are operated in conjunction with each other. The timing generation circuit 22 is intended to output a control signal 22A to the foregoing respective circuits according to (in sync with), for example, a synchronization signal 20B inputted from outside.

The signal line drive circuit 23 is intended to apply an analog video signal corresponding to the video signal 21A to each signal line DTL according to (in sync with) input of the control signal 22A, and to write the analog video signal or a signal corresponding thereto into the pixel circuit 14 as a selection target. Specifically, the signal line drive circuit 23 is intended to apply a signal voltage $V_{sig}$ corresponding to the video signal 21A to each signal line DTL, and perform writing into the pixel circuit 14 as a selection target. Writing means applying a given voltage to the gate of the drive transistor $Tr_1$.

Further, the signal line drive circuit 23 is intended to sequentially apply a selection voltage according to the duty ratio size set by the video signal processing circuit 21 to each signal line according to (in sync with) input of the control signal 22A, and perform writing into the pixel circuit as a selection target. Specifically, the signal line drive circuit 23 is intended to apply a voltage $V_{ers}$ as a selection voltage to a specific signal line DTL according to input of the erasing control signal 21B outputted from the video signal processing circuit 21, and perform writing into the pixel circuit 14 as a selection target. In other words, the signal line drive circuit 23 is intended to apply the erasing pulse to decreasing the voltage from $V_{sig}$ to $V_{ers}$ to the specific signal line DTL according to input of the erasing control signal 21B outputted from the video signal processing circuit 21, and perform writing into the pixel circuit 14 as a selection target. Further, it is possible that the signal line drive circuit 23 applies a voltage $V_{ofs}$ as a selection voltage to the specific signal line DTL according to input of the erasing control signal 21B outputted from the video signal processing circuit 21, and does not perform writing into the pixel circuit 14 as a selection target.

The signal line drive circuit 23 is able to output, for example, the signal voltage $V_{sig}$ and the voltages $V_{ofs1}$ and $V_{ers}$ applied to the gate of the drive transistor $Tr_1$ at the time of light extinction of the organic EL device 11. The value of the voltage $V_{ofs}$ is lower than that of a threshold voltage $V_{e1}$ of the organic EL device 11 (constant value), and is higher than that of $V_M-V_{th-ws}$. The voltage $V_{ofs}$ is applied to the signal line DTL during the after-mentioned erasing selection period in the case where non-erasing is selected by the erasing control signal 21B.

The voltage $V_M$ is a voltage (constant value) applied to the scanning line WSL during the after-mentioned erasing selection period $T_{ers}$ in the case where erasing is selected by the video signal processing circuit 21. The value of the voltage $V_M$ is higher than that of a voltage $V_L$ and lower than that of a voltage $V_H$ (constant value). The value of the voltage $V_L$ is lower than that of an ON voltage of the writing transistor $Tr_2$ (constant value). The value of the voltage $V_H$ is equal to or higher than that of the ON voltage of the writing transistor $Tr_2$ (constant value). The voltage $V_{th-ws}$ is a threshold voltage of the writing transistor $Tr_2$. The voltage $V_{ers}$ is applied to the signal line DTL during the after-mentioned erasing selection period $T_{ers}$ in the case where erasing is selected by the video signal processing circuit 21. The value of the voltage $V_{ers}$ is higher than $V_L-V_{th-ws}$ and lower than $V_M-V_{th-ws}$ (constant value).

The scanning line drive circuit 24 sequentially applies a selection pulse to the plurality of scanning lines WSL according to (in sync with) input of the control signal 22A, and sequentially selects the plurality of organic EL devices 11 and the plurality of pixel circuits 14. Further, according to (in sync with) input of the control signal 22A, during the time period when the foregoing selection voltage (voltage $V_{ers}$) is applied to the signal line DTL, the scanning line drive circuit 24 applies a selection pulse having a height value (voltage $V_M$) smaller than a height value (voltage $V_H$) of a selection pulse applied during the time period other than the time period when the foregoing selection voltage (voltage $V_{ers}$) is applied to the signal line DTL to the scanning lien WSL. For example, the scanning line drive circuit 24 is able to output the voltage $V_H$ applied in the case where the writing transistor $Tr_2$ is turned on, the voltage $V_M$ applied in the case where whether the writing transistor $Tr_2$ is turned on or off is selected, and the voltage $V_L$ applied in the case where the writing transistor $Tr_2$ is turned off.

The power source line drive circuit 25 is intended to sequentially apply a control pulse to the plurality of power source lines PSL according to (in sync with) input of the control signal 22A, and control light emission and light extinction of the organic EL device 11. For example, the power source line drive circuit 25 is able to output a voltage $V_{ccH}$ applied in the case where a current is flown to the drive transistor $Tr_1$ and a voltage $V_{ccL}$ applied in the case where a current is not flown to the drive transistor $Tr_1$. The value of the voltage $V_{ccL}$ is lower than that of a voltage obtained by adding a threshold voltage $V_{e1}$ of the organic EL device 11 to a voltage $V_{ca}$ of the cathode of the organic EL device 11 ($V_{e1}+V_{ca}$) (constant value). The value of $V_{ccH}$ is equal to or higher than that of the voltage ($V_{e1}+V_{ca}$) (constant value).

1.2 Operation of Video Signal Processing Circuit 21

FIG. 3 illustrates an example of processing flow in the video signal processing circuit 21. The video signal processing circuit 21 sets the duty ratio as follows. For example, as illustrated in FIG. 3, the video signal processing circuit 21 separates one frame period $T_F$ into light extinction period $T_{off}$, light emitting selection period $T_{on1}$, light emitting selection period $T_{on2}$, light emitting selection period $T_{on3}$, and light emitting selection period $T_{on4}$. The light extinction period $T_{off}$ is also period when $V_{th}$ correction, μ correction and the like are performed as described later. Next, for example, as illustrated in FIG. 4, the video signal processing circuit 21 selects the duty ratio corresponding to the size of the video signal 20A or the video signal 21A from the group consisting of duty ratios of mode 1 to mode 4.

Mode 1 is a mode for selecting "light emission" during the light emitting selection period $T_{on1}$, and selecting "non light emission" during the light emitting selection periods $T_{on2}$, $T_{on3}$, and $T_{on4}$. Mode 2 is a mode for selecting "light emission" during the light emitting selection periods $L_{on1}$ and $T_{on2}$, and selecting "non light emission" during the light emitting selection periods $T_{on3}$ and $T_{on4}$. Mode 3 is a mode for selecting "light emission" during the light emitting selection periods $T_{on1}$, $T_{on2}$, $T_{on3}$, and selecting "non light emission" during the light emitting selection period $T_{on4}$. Mode 4 is a mode for selecting "light emission" during the light emitting selection periods $L_{on1}$, $T_{on2}$, $T_{on3}$, and $T_{on4}$.

Next, the video signal processing circuit 21 outputs the video signal 21A to the signal line drive circuit 23 at given timing, and outputs the erasing control signal 21B corresponding to the mode to the signal line drive circuit 23 at given timing. For example, in the case where the erasing control signal 21B is applied to the signal line drive circuit 23 in the case of mode 3, the signal line drive circuit 23 applies the voltage $V_{ofs}$ to the signal line DTL during the first to the third erasing selection periods $T_{ers}$ in FIG. 5, and applies the voltage $V_{ers}$ to the signal line DTL during the fourth erasing selection period $T_{ers}$ in FIG. 5. Further, for example, in the case where the erasing control signal 21B is applied to the signal line drive circuit 23 in the case of mode 4, the signal line drive circuit 23 applies the voltage $V_{ofs}$ to the signal line DTL during the all erasing selection periods $T_{ers}$ in FIG. 6.

1.3. Operation of Display Unit

Figure 5:
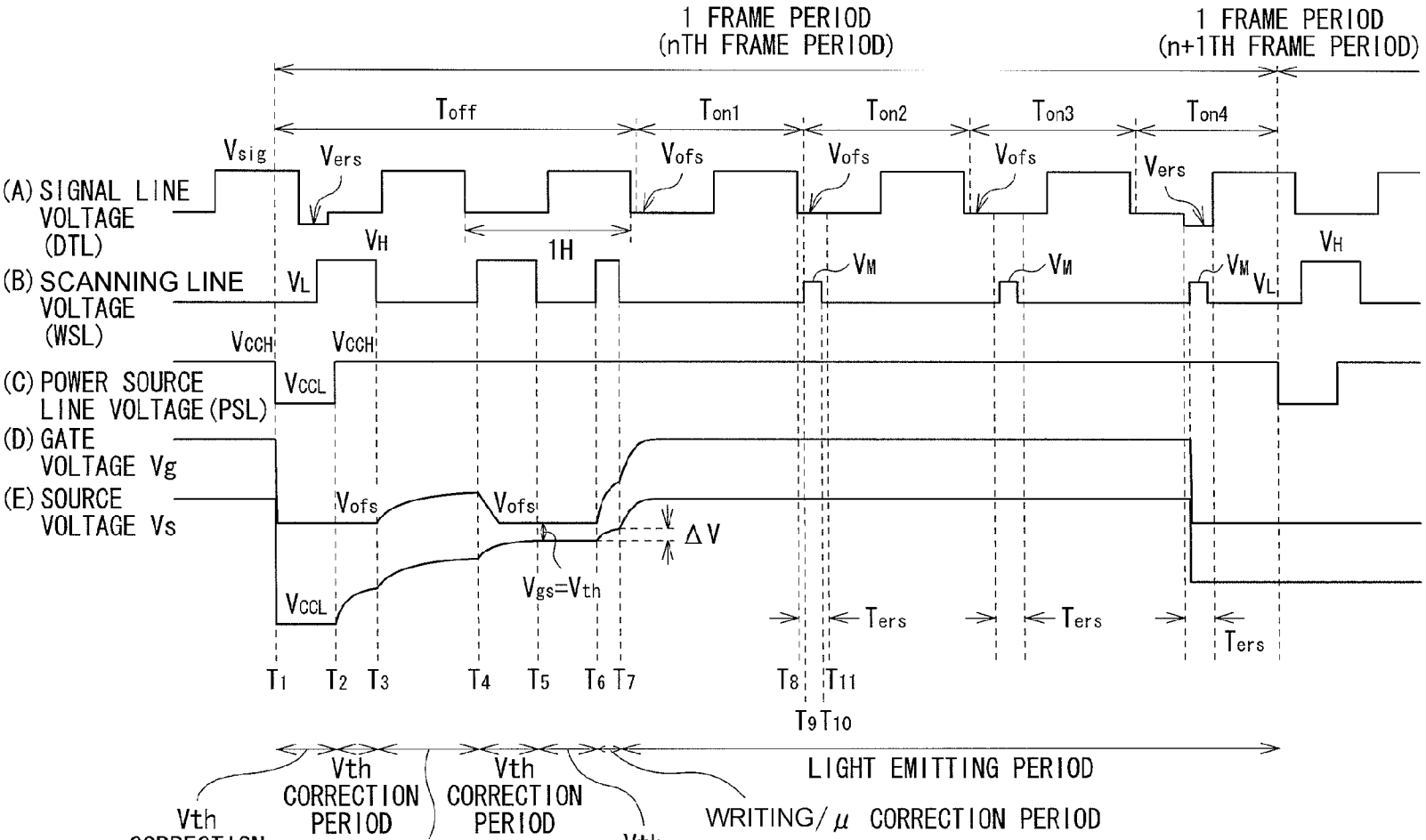
FIG. 5 is a waveform chart for explaining an example of operation in mode 3 of the display unit of FIG. 1.
Figure 6:
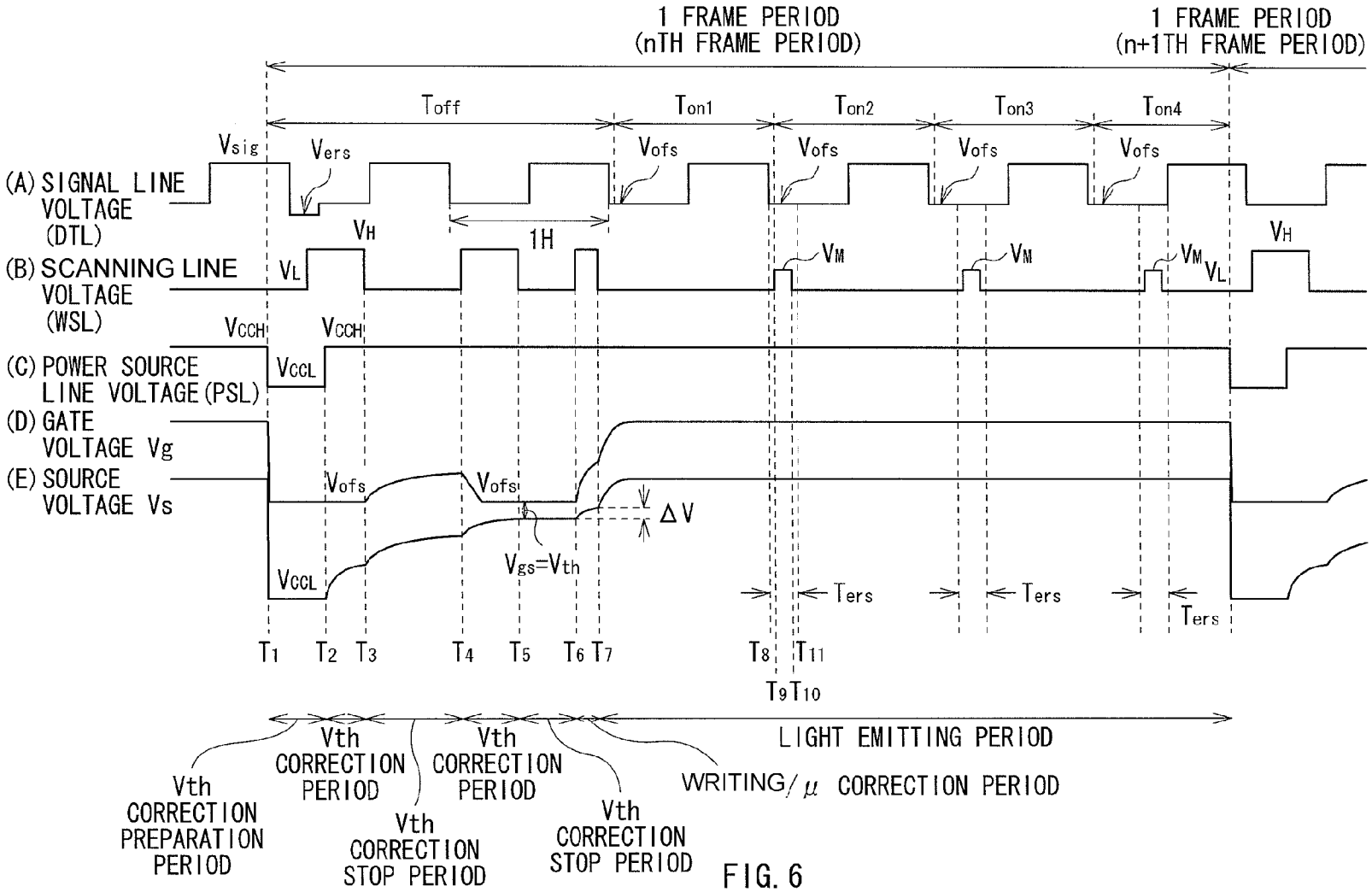
FIG. 6 is a waveform chart for explaining an example of operation in mode 4 of the display unit of FIG. 1.

FIG. 5 illustrates an example of various waveforms in the case where the display unit 1 is driven in mode 3. FIG. 6 illustrates an example of various waveforms in the case where the display unit 1 is driven in mode 4. Part A to part C in FIG. 5 and part A to part C in FIG. 6 illustrate a state in which $V_{ofs1}$, $V_{ofs2}$, and $V_{ers}$ are cyclically applied to the signal line DTL, $V_H$, $V_L$, and $V_M$ are applied to the scanning line WSL at given timing, and $V_{ccL}$ and $V_{ccH}$ are applied to the power source line PSL at given timing. Part D and part E in FIG. 5 and part D and part E in FIG. 6 illustrate a state in which a gate voltage $V_g$ and a source voltage $V_s$ of the drive transistor $Tr_1$ are ever-changed according to applying a voltage to the signal line DTL, the scanning line WSL, and the power source line PSL. A description will be firstly given of operation common to all modes, and subsequently of respective operations of the respective modes.

$V_{th}$ Correction Preparation Period

First, $V_{th}$ correction preparation is performed. Specifically, the power source line drive circuit 25 decreases the voltage of the power source line PSL from $V_{ccH}$ to $V_{ccL}$ ($T_1$). Accordingly, the source voltage $V_s$ becomes $V_{ccL}$, the organic EL device 11 is extinct, and the gate voltage $V_g$ is decreased down to $V_{ofs}$. Next, while the voltage of the signal line DTL is $V_{ofs}$ and the voltage of the power source line PSL is $V_{ccL}$, the scanning line drive circuit 24 increases the voltage of the scanning line WSL from $V_L$ to $V_H$.

First $V_{th}$ Correction Period

Next, $V_{th}$ correction is performed. Specifically, while the voltage of the signal line DTL is $V_{ofs}$, the power source line drive circuit 25 increases the voltage of the power source line PSL from $V_{ccL}$ to $V_{ccH}$ ($T_2$). Accordingly, a current $I_d$ is flown between the drain and the source of the drive transistor $Tr_1$, and the source voltage $V_s$ is increased. After that, before the signal line drive circuit 23 changes the voltage of the signal line DTL from $V_{ofs}$ to $V_{sig}$, the scanning line drive circuit 24 decreases the voltage of the scanning line WSL from $V_H$ to $V_L$ ($T_3$). Accordingly, the gate of the drive transistor $Tr_1$ becomes floating, and $V_{th}$ correction is stopped at once.

First $V_{th}$ Correction Stop Period

While $V_{th}$ correction is stopped, in a row (pixel) different from the row (pixel) provided with the precedent $V_{th}$ correction, sampling of the voltage of the signal line DTL is performed. In the case where $V_{th}$ correction is not sufficient, that is, in the case where an electric potential difference $V_{gs}$ between the gate and the source of the drive transistor $Tr_1$ is larger than the threshold voltage $V_{th}$ of the drive transistor $Tr_1$, it results in as follows. That is, even in the $V_{th}$ correction stop period, in the row (pixel) provided with the precedent $V_{th}$ correction, a current $I_{ds}$ is flown between the drain and the source of the drive transistor $Tr_1$, the source voltage $V_s$ is increased, and the gate voltage $V_g$ is also increased due to coupling through the retentive capacity $C_s$.

Second $V_{th}$ Correction Period

After the $V_{th}$ correction stop period is finished, $V_{th}$ correction is performed again. Specifically, while the voltage of the signal line DTL is $V_{ofs}$ and $V_{th}$ correction is available, the scanning line drive circuit 24 increases the voltage of the scanning line WSL from $V_L$ to $V_H$ ($T_4$), and connects the gate of the drive transistor $Tr_1$ to the signal line DTL. At this time, in the case where the source voltage $V_s$ is lower than ($V_{ofs}-V_{th}$) (in the case where $V_{th}$ correction is not completed yet), the current $I_d$ is flown between the drain and the source of the drive transistor $Tr_1$ until the drive transistor $Tr_1$ is cut off (until the electric potential difference $V_{gs}$ becomes $V_{th}$). In the result, the retentive capacity $C_s$ is charged with $V_{th}$, and the electric potential difference $V_{gs}$ becomes $V_{th}$. After that, before the signal line drive circuit 23 changes the voltage of the signal line DTL from $V_{ofs}$ to $V_{sig}$, the scanning line drive circuit 24 decreases the voltage of the scanning line WSL from $V_H$ to $V_L$ ($T_5$). Accordingly, the gate of the drive transistor $Tr_1$ becomes floating, and thus the electric potential difference $V_{gs}$ is kept at $V_{th}$ without relation to the voltage size of the signal line DTL. As described above, by setting the electric potential difference $V_{gs}$ to $V_{th}$, even if the threshold voltage $V_{th}$ of the drive transistor $Tr_1$ varies according to each pixel circuit 14, variation of the light emitting luminance of the organic EL device 11 is able to be prevented.

Second $V_{th}$ Correction Stop Period

After that, while $V_{th}$ correction is stopped, the signal line drive circuit 23 changes the voltage of the signal line DTL from $V_{ofs}$ to $V_{sig}$.

Writing and μ Correction Period

After the $V_{th}$ correction stop period is finished, writing and μ correction are performed. Specifically, while the voltage of the signal line DTL is $V_{sig}$, the scanning line drive circuit 24 increases the voltage of the scanning line WSL from $V_L$ to $V_H$ ($T_6$), and connects the gate of the drive transistor $Tr_1$ to the signal line DTL. Accordingly, the gate voltage of the drive transistor $Tr_1$ becomes $V_{sig}$. At this time, an anode voltage of the organic EL device 11 is smaller than the threshold voltage $V_{e1}$ of the organic EL device 11 yet in this stage, and the organic EL device 11 is cut off Thus, the current $I_{ds}$ is flown to a device capacity (not illustrated) of the organic EL device 11, and the device capacity is charged. Thus, the source voltage $V_s$ is increased by ΔV, and the electric potential difference $V_{gs}$ becomes $V_{sig}+V_{th}-\Delta V$. As described above, μ correction is performed concurrently with writing. As mobility μ of the drive transistor $Tr_1$ is larger, ΔV becomes larger. Thus, by decreasing the electric potential difference $V_{gs}$ by ΔV before light emission, variation of the mobility μ for every pixel circuit 14 is able to be removed.

Light Emission Selection Period ($T_{on1}$)

Next, the scanning line drive circuit 24 decreases the voltage of the scanning line WSL from $V_H$ to $V_L$ ($T_7$). Accordingly, the gate of the drive transistor $Tr_1$ becomes floating, the voltage $V_{gs}$ between the gate and the source of the drive transistor $Tr_1$ is maintained constantly, while the current $I_d$ is flown between the drain and the source of the drive transistor $Tr_1$. In the result, the source voltage $V_s$ is increased, the gate of the drive transistor $Tr_1$ is increased in conjunction therewith, and the organic EL device 11 emits light at desired luminance ($T_8$).

Next, a description will be given of operation in the case where mode 3 is selected with reference to FIG. 5.

Light Emitting Selection Period ($T_{on1}$)

When a given period lapses after the organic EL device 11 starts to emit light, the signal line drive circuit 23 decreases the voltage of the signal line DTL from $V_{sig}$ to $V_{ofs}$ correspondingly to application of the erasing control signal 21B, and it gets to the first erasing selection period $T_{ers}$ ($T_8$). Subsequently, the scanning line drive circuit 24 increases the voltage of the scanning line WSL from $V_L$ to $V_M$ ($T_9$). At this time, the voltage $V_{gs}$ between the gate and the source of the writing transistor $Tr_2$ is $V_M-V_{ofs}$, and is smaller than the threshold voltage $V_{th\,ws}$ of the writing transistor $Tr_2$. Thus, the writing transistor $Tr_2$ is kept off, and the gate of the drive transistor $Tr_1$ is kept in the floating state. Thus, the organic EL device 11 continuously emits light. After that, while the voltage of the signal line DTL is $V_{ofs}$, the scanning line drive circuit 24 decreases the voltage of the scanning line WSL from $V_M$ to $V_L$. At this time, again, the writing transistor $Tr_2$ is kept off, and the gate of the drive transistor $Tr_1$ is kept in the floating state. Thus, the organic EL device 11 continuously emits light. After that, the signal line drive circuit 23 increases the voltage of the signal line DTL from $V_{ofs}$ to $V_{sig}$.

Light Emitting Selection Period ($T_{on2}$ and $T_{on3}$)

On and after that, during the light emitting selection period ($T_{on2}$ and $T_{on3}$), the foregoing step is repeated. In the state that the organic EL device 11 continuously emits light, the second and the third erasing selection periods $T_{ers}$ elapse.

Light Emitting Selection Period ($T_{on4}$)

Next, the signal line drive circuit 23 decreases the voltage of the signal line DTL from $V_{sig}$ to $V_{ers}$ correspondingly to application of the erasing control signal 21B, and it gets to the fourth erasing selection period $T_{ers}$ ($T_8$). During this erasing selection period $T_{ers}$, the voltage of the signal line DTL is $V_{ers}$, and non light emission of the organic EL device 11 is selected. That is, the erasing pulse (falling signal from the voltage $V_{sig}$ to the voltage $V_{ers}$) is applied to the specific signal line DTL at timing of start of the light emitting selection period ($T_{on4}$) so that the duty ratio determined based on the video signal 20A or the video signal 21A is obtained ($T_9$). Accordingly, the gate of the drive transistor $Tr_1$ is connected to the signal line DTL, the gate voltage of the drive transistor $Tr_1$ becomes $V_{ers}$, and the voltage $V_{gs}$ between the gate and the source of the drive transistor $Tr_1$ becomes $V_{ers}-V_{e1}<V_{th}$, and light emission of the organic EL device is stopped. That is, the signal line drive circuit 23 applies the voltage $V_{ers}$ to the signal line DTL during the fourth erasing selection period $T_{ers}$ correspondingly to application of the erasing control signal 21B, and a stationary current flown to the organic EL device as a selection target is stopped. After that, while the voltage of the signal line DTL is $V_{ers}$, the scanning line drive circuit 24 decreases the voltage of the scanning line WSL from $V_M$ to $V_L$. Accordingly, the gate of the drive transistor $Tr_1$ is kept in the floating state. After that, light emission of the organic EL device 11 is continuously stopped.

In the display unit 1 of this embodiment, as described above, the pixel circuit 14 is on/off controlled in each pixel 12, and a drive current is injected into the organic EL device 11 of each pixel 12. Thereby, electron hole recombination is generated, leading to light emission. The light is multiply reflected between the anode and the cathode, is transmitted through the cathode or the like, and extracted outside. In the result, an image is displayed on the display panel 10.

1.4 Action and Effect

In the existing organic EL display unit, in general, in executing light emission and light extinction of the organic EL device during one frame period, the duty ratio between light emitting period and light extinction period as a ratio of light emitting period during one field period (light emitting period/1 field period*100) is constant for all pixels. Thus, in the case where the number of gradations is increased, the voltage value capable of being applied to a signal line is increased. However, in this case, the voltage value difference between each gradation becomes small, and gradation control becomes difficult.

Meanwhile, in this embodiment, writing into the pixel circuit 14 as a selection target is performed by applying the signal voltage $V_{sig}$ corresponding to the video signal 21A to each signal line DTL. Further, the erasing pulse (voltage $V_{ers}$) is applied to the specific signal line DTL at given timing so that the duty ratio determined based on the video signal 20A or the video signal 21A is obtained. Further, the voltage of the scanning line WSL is increased from $V_L$ to $V_M$ so that the voltage $V_{gs}$ between the gate and the source of the drive transistor $Tr_1$ in the pixel circuit 14 corresponding to the specific signal line DTL is lower than $V_{th}$ while the erasing pulse (voltage $V_{ers}$) is applied to the specific signal line DTL. Thereby, light emission of the organic EL device 11 in the specific pixel 12 is stopped. Thereby, not only that the height value of the signal voltage $V_{sig}$ is able to be set for every pixel 12, but also the duty ratio is able to be set for every pixel 12. Therefore, compared to the foregoing existing case, gradation control is more facilitated.

2. Module and Application Examples

A description will be given of application examples of the display unit described in the foregoing embodiment. The display unit of the foregoing embodiment is able to be applied to a display unit of electronics devices in any field for displaying a video signal inputted from outside or a video signal generated inside as an image or a video such as a television device, a digital camera, a notebook personal computer, a portable terminal device such as a mobile phone, and a video camera.

Module

Figure 7:
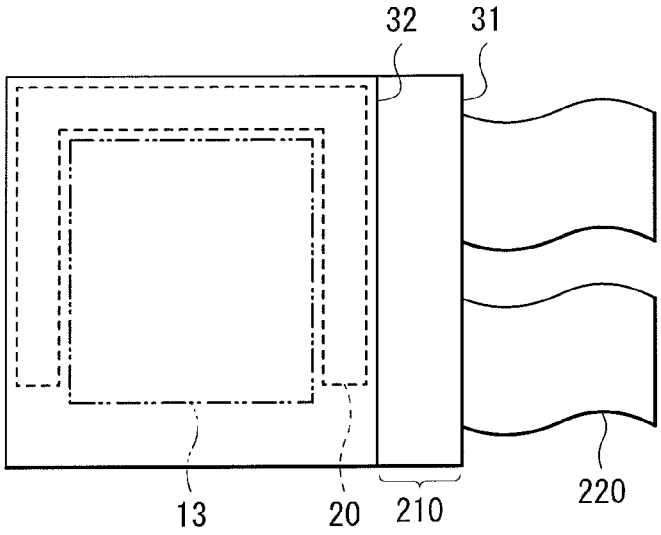
FIG. 7 is a plan view illustrating a schematic structure of a module including the display unit of the foregoing embodiment.

The display unit 1 of the foregoing embodiment is incorporated in various electronics devices such as after-mentioned first to fifth application examples as a module as illustrated in FIG. 7, for example. In the module, for example, a region 210 exposed from a sealing substrate 32 is provided in a side of a substrate 31, and an external connection terminal (not illustrated) is formed in the exposed region 210 by extending wirings of the drive circuit 20. The external connection terminal may be provided with a Flexible Printed Circuit (FPC) 220 for inputting and outputting a signal.

First Application Example

Figure 8:
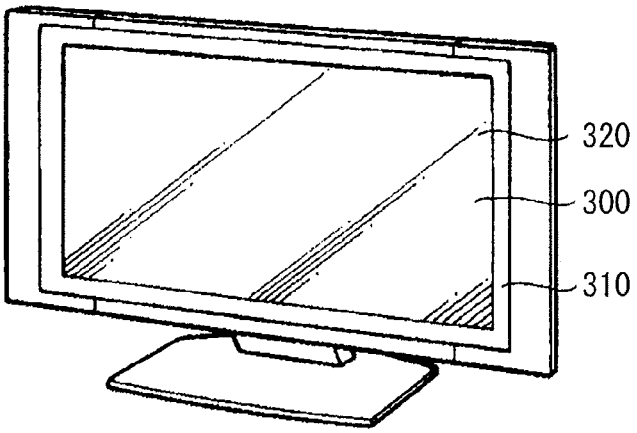
FIG. 8 is a perspective view illustrating an appearance of a first application example of the display unit of the foregoing embodiment.

FIG. 8 illustrates an appearance of a television device to which the display unit 1 of the foregoing embodiment is applied. The television device has, for example, a video display screen section 300 including a front panel 310 and a filter glass 320. The video display screen section 300 is composed of the display unit 1 according to the foregoing embodiment.

Second Application Example

Figure 9A:
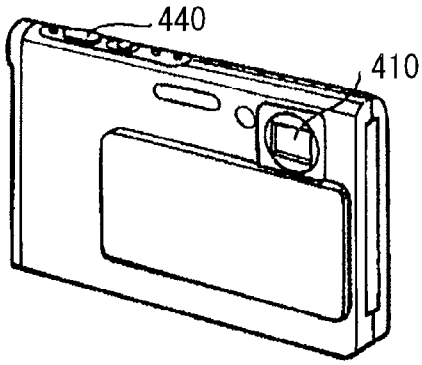
FIG. 9A is a perspective view illustrating an appearance viewed from the front side of a second application example.
Figure 9B:
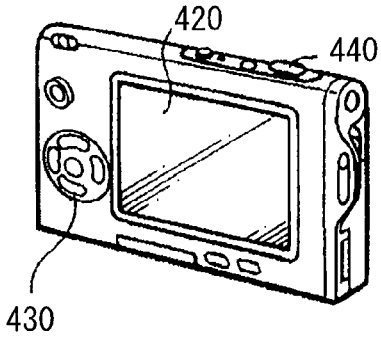
FIG. 9B is a perspective view illustrating an appearance viewed from the rear side of the second application example.

FIGS. 9A and 9B illustrate an appearance of a digital camera to which the display unit 1 of the foregoing embodiment is applied. The digital camera has, for example, a light emitting section for a flash 410, a display section 420, a menu switch 430, and a shutter button 440. The display section 420 is composed of the display unit 1 according to the foregoing embodiment.

Third Application Example

Figure 10:
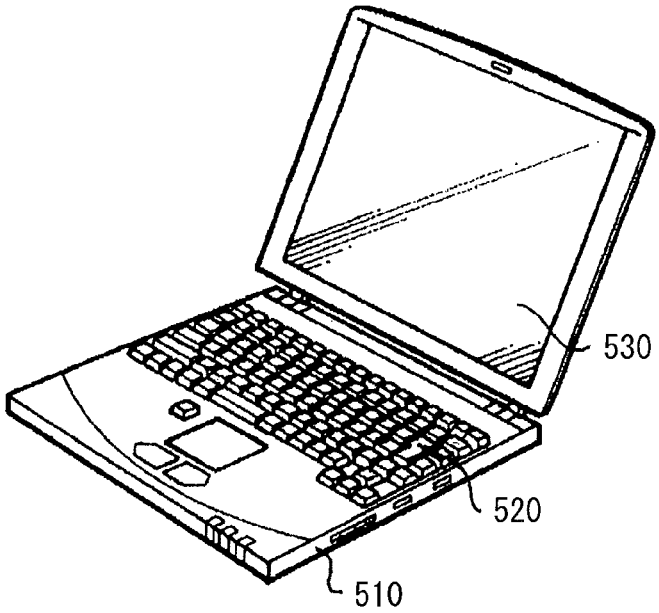
FIG. 10 is a perspective view illustrating an appearance of a third application example.

FIG. 10 illustrates an appearance of a notebook personal computer to which the display unit 1 of the foregoing embodiment is applied. The notebook personal computer has, for example, a main body 510, a keyboard 520 for operation of inputting characters and the like, and a display section 530 for displaying an image. The display section 530 is composed of the display unit 1 according to the foregoing embodiment.

Fourth Application Example

Figure 11:
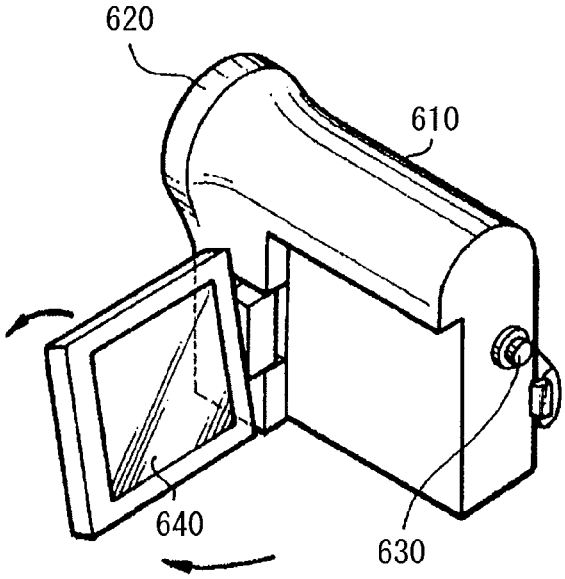
FIG. 11 is a perspective view illustrating an appearance of a fourth application example.
Figures 12A, 12B, 12C, 12D, 12E, 12F, 12G:
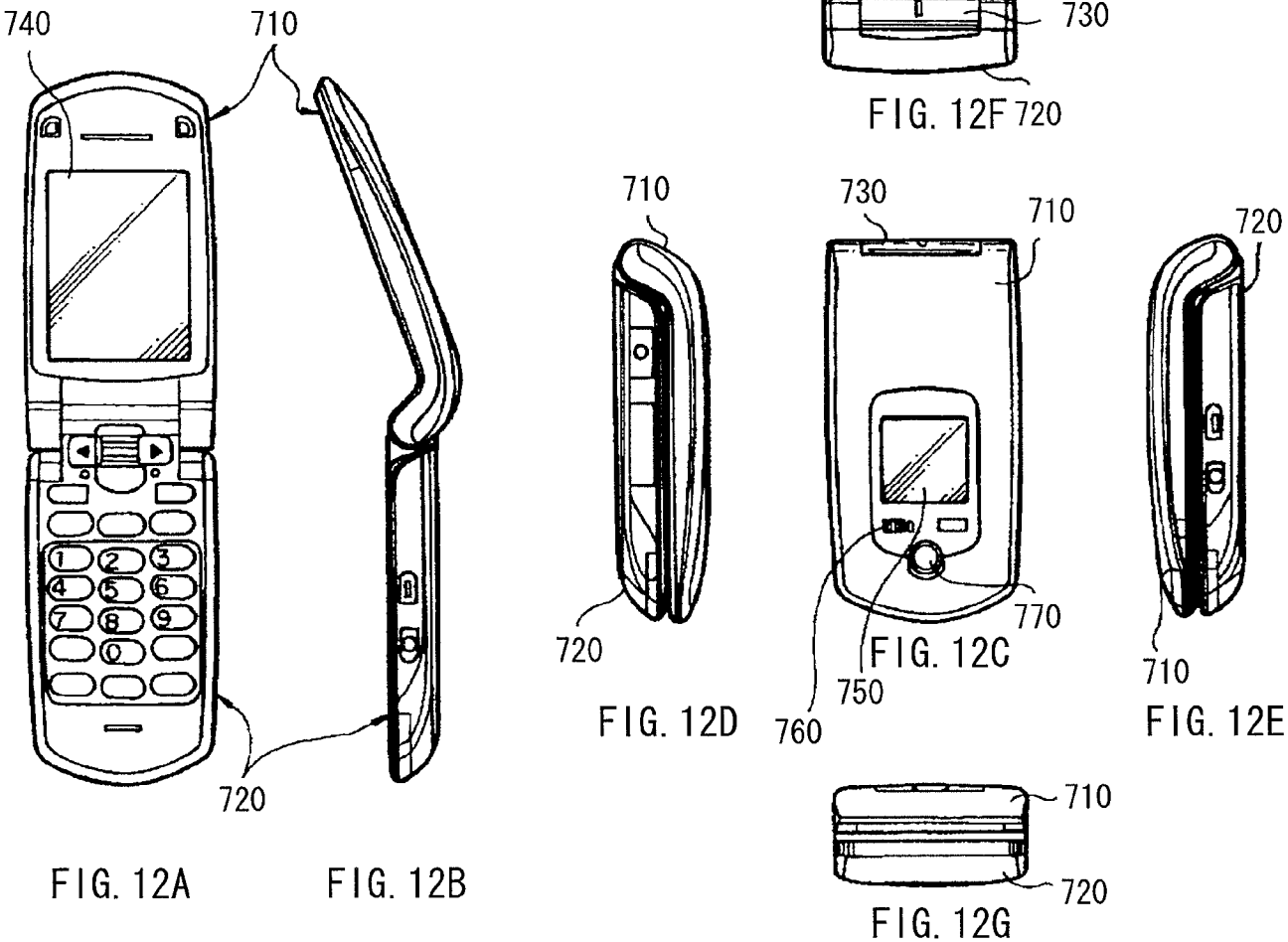
FIG. 12A is an elevation view of a fifth application example unclosed.
FIG. 12B is a side view thereof.
FIG. 12C is an elevation view of the fifth application example closed.
FIG. 12D is a left side view thereof.
FIG. 12E is a right side view thereof.
FIG. 12F is a top view thereof.
FIG. 12G is a bottom view thereof.

FIG. 11 illustrates an appearance of a video camera to which the display unit 1 of the foregoing embodiment is applied. The video camera has, for example, a main body 610, a lens for capturing an object 620 provided on the front side face of the main body 610, a start/stop switch in capturing 630, and a display section 640. The display section 640 is composed of the display unit 1 according to the foregoing embodiment.

Fifth Application Example

FIGS. 12A to 12G illustrate an appearance of a mobile phone to which the display unit 1 of the foregoing embodiment is applied. In the mobile phone, for example, an upper package 710 and a lower package 720 are jointed by a joint section (hinge section) 730. The mobile phone has a display 740, a sub-display 750, a picture light 760, and a camera 770. The display 740 or the sub-display 750 is composed of the display unit 1 according to the foregoing embodiment.

While the invention has been described with reference to the embodiment and the application examples, the invention is not limited to the foregoing embodiment and the like, and various modifications may be made.

For example, in the foregoing embodiment and the like, the description has been given of the case that the display unit 1 is an active matrix type. However, the structure of the pixel circuit 14 for driving the active matrix is not limited to the case described in the foregoing embodiment and the like, and a capacity device or a transistor may be added to the pixel circuit 14 according to needs. In this case, according to the change of the pixel circuit 14, a necessary drive circuit may be added in addition to the signal line drive circuit 23, the scanning line drive circuit 24, and the power source line drive circuit 25 described above.

Further, in the foregoing embodiment and the like, driving of the signal line drive circuit 23, the scanning line drive circuit 24, and the power source line drive circuit 25 is controlled by the timing control circuit 22. However, other circuit may control driving of the signal line drive circuit 23, the scanning line drive circuit 24, and the power source line drive circuit 25. Further, the signal line drive circuit 23, the scanning line drive circuit 24, and the power source line drive circuit 25 may be controlled by a hardware (circuit) or may be controlled by software (program).

Further, in the foregoing embodiment and the like, the description has been given of the case that the pixel circuit 14 has the 2Tr1C circuit structure. However, as long as a circuit structure in which a transistor is connected to the organic EL device 11 in series is included, a circuit structure other than the 2Tr1C circuit structure may be adopted.

Further, in the foregoing embodiment and the like, the description has been given of the case that the drive transistor $T_{r1}$ and the writing transistor $T_{r2}$ are formed from the n channel MOS type thin film transistor (TFT). However, it is possible that the drive transistor $T_{r1}$ and the writing transistor $T_{r2}$ are formed from a p channel transistor (for example, p channel MOS type TFT). However, in this case, it is preferable that one of the source and the drain of the transistor $T_{r2}$ that is not connected to the power source line PSL and the other end of the retentive capacity $C_s$ are connected to the cathode of the organic EL device 11, and the anode of the organic EL device 11 is connected to the GND or the like.

The present application contains subject matter related to that disclosed in Japanese Priority Patent Application JP 2009-165378 filed in the Japanese Patent Office on Jul. 14, 2009, the entire contents of which is hereby incorporated by reference.

It should be understood by those skilled in the art that various modifications, combinations, sub-combinations and alternations may occur depending on design requirements and other factors insofar as they are within the scope of the appended claims or the equivalents thereof.

What is claimed is:

1. A display unit comprising:

a pixel circuit array section that includes a plurality of scanning lines arranged in rows, a plurality of signal lines arranged in columns, a plurality of light emitting devices, and a plurality of pixel circuits arranged in a matrix corresponding to intersections of the plurality of scanning lines and the plurality of signal lines;

a signal line drive circuit that sequentially applies a signal voltage corresponding to a video signal to each of the plurality of signal lines, and selectively applies an erasing pulse to a selected one of the plurality of signal lines after a writing period occurs within a frame period such that a duty ratio based on the video signal is obtained; and a scanning line drive circuit that applies a selection pulse to a scanning line while the erasing pulse is applied to the selected signal line, the selection pulse having a voltage value that is greater than zero and different from a voltage value of another selection pulse that is greater than zero and applied to the scanning line during another time period within the frame period prior to the writing period.

2. The display unit according to claim 1, wherein the voltage value of the selection pulse is less than that of the voltage value of the another selection pulse that is applied to the scanning line during the another time period, the another time period being different from a time period in which the erasing pulse is applied to the selected signal line.

3. The display unit of claim 1, wherein:

a voltage of the erasing pulse is less than the signal voltage corresponding to the video signal, and the signal line drive circuit applies the erasing pulse to the selected signal line to decrease a voltage of the selected signal line from the signal voltage to the voltage level of the erasing pulse.

4. The display unit of claim 1, wherein the scanning line drive circuit is enabled to apply a voltage $V_L$ to the scanning line when the erasing pulse is applied, the voltage $V_L$ being a voltage value less than that of the selection pulse.

5. The display unit of claim 1, wherein the signal line drive circuit is enabled to apply a voltage $V_{ofs}$ to the selected one of the plurality of signal lines, the selection voltage $V_{ofs}$ having a voltage value greater than that of the erasing pulse.

6. A method of driving a display unit, the display unit comprising a pixel circuit array section including a plurality of scanning lines arranged in rows, a plurality of signal lines arranged in columns, a plurality of light emitting devices, and a plurality of pixel circuits arranged in a matrix corresponding to intersections of the plurality of scanning lines and the plurality of signal lines and a drive circuit that drives the pixel circuit array section, the method comprising:

sequentially applying a signal voltage corresponding to a video signal to each of the plurality of signal lines, and selectively applying an erasing pulse to a selected one of the plurality of signal lines after a writing period occurs within a frame period such that a duty ratio based on the video signal is obtained; and applying a selection pulse to a scanning line while the erasing pulse is applied to the selected signal line, the selection pulse having a voltage value that is greater than zero and different from a voltage value of another selection pulse that is greater than zero and applied to the scanning line during another time period within the frame period prior to the writing period.

7. An electronics device comprising:

a display unit, the display unit including a pixel circuit array section that includes a plurality of scanning lines arranged in rows, a plurality of signal lines arranged in columns, a plurality of light emitting devices, and a plurality of pixel circuits arranged in a matrix corresponding to intersections of the plurality of scanning lines and the plurality of signal lines, a signal line drive circuit that sequentially applies a signal voltage corresponding to a video signal to each of the plurality of signal lines, and selectively applies an erasing pulse to a selected one of the plurality of signal lines after a writing period occurs within a frame period such that a duty ratio based on the video signal is obtained, and a scanning line drive circuit that applies a selection pulse to a scanning line while the erasing pulse is applied to the selected signal line, the selection pulse having a voltage value that is greater than zero and different from a voltage value of another selection pulse that is greater than zero and applied to the scanning line during another time period within the frame period prior to the writing period.

* * * * *